US006346936B2

(12) United States Patent
Murayama et al.

(10) Patent No.: US 6,346,936 B2
(45) **Date of Patent: *Feb. 12, 2002**

(54) LIQUID CRYSTAL DRIVING DEVICE

(75) Inventors: Hiroshi Murayama, Kanagawa; Osamu Maekawa, Tokyo, both of (JP)

(73) Assignee: Sony Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/107,219

(22) Filed: Jun. 29, 1998

(30) Foreign Application Priority Data

Jun. 30, 1997 (JP) ..... 9-173718

(51) Int. Cl.[7] ..... G09G 5/00
(52) U.S. Cl. ..... 345/208; 345/100
(58) Field of Search ..... 345/88, 98, 100, 345/99, 96, 94, 213, 208

(56) References Cited

U.S. PATENT DOCUMENTS 5,091,784 A * 2/1992 Someya et al. ..... 358/183
5,546,102 A * 8/1996 Scheffer et al. ..... 345/100
5,654,735 A * 8/1997 Nakajima ..... 345/99
5,731,796 A * 3/1998 Furuhashi et al. ..... 345/96
5,751,261 A * 5/1998 Zavracky et al. ..... 345/55
5,818,413 A * 10/1998 Hayashi et al. ..... 345/100
5,852,429 A * 12/1998 Scheffer et al. ..... 345/100
5,877,802 A * 3/1999 Takahashi et al. ..... 348/71
5,926,174 A * 7/1999 Shibamiya et al. ..... 345/213
5,959,691 A * 9/1999 Koh ..... 348/581
6,014,177 A * 1/2000 Nozawa ..... 348/540
6,097,379 A * 8/2000 Ichiraku ..... 345/213

* cited by examiner

*Primary Examiner*—Bipin Shalwala
*Assistant Examiner*—Vanel Frenel
(74) *Attorney, Agent, or Firm*—Frommer Lawrence & Haug LLP; William S. Frommer; Darren M. Simon

(57) ABSTRACT

In order to remove high-frequency components contained in video signals and high-frequency components occurring in a processing stage of the video signals, a method of filtering the video signals has a problem that it has a strong side reaction that sharpness is greatly deteriorated and it is liable to suffer an effect of dispersion of elements when the filter comprises an analog circuit, and thus the problem of the present invention to be solved is to effectively remove the high-frequency components. In the liquid crystal driving device of the present invention, a timing circuit 4 for generating a sampling pulse is constructed by an PLL circuit 41, a phase shifter 47 for periodically shifting the clock phase to vary the sampling phase and periodically varying the phase relationship between signals and pixels, and input means for alternating signals which comprise periodical waveform and modulated by a pulse wave every line or every field, the fixed pixels being restructured by periodically varying the phase relationship between the signals and the pixels, thereby bringing a visual filtering effect.

4 Claims, 9 Drawing Sheets

LIQUID CRYSTAL DRIVING DEVICE

BACKGROUND OF THE INVENTION

1. Field of the Invention

The present invention relates to a liquid crystal driving device for driving a display device such as a liquid crystal display projector or the like.

2. Description of the Related Art

First, the system construction of a conventional liquid crystal driving device and the construction and function of each part will be briefly described.

FIG. 1 is a block diagram showing an example of the overall system construction of a conventional liquid crystal driving device. Reference numeral 10 represents an RGB signal processing circuit, reference numerals 20R, 20G, 20B represent RGB drivers, reference numerals 30R, 30G, 30B represent LCD panels, and reference numeral 40 represents a timing generator.

FIG. 1 shows a three-plate type projector in which an individual panel is used for each of R, G, B colors, and three LCD panels 30R, 30G, 30B are disposed.

The RGB signal processing circuit 10 has a function of performing pre-processing of an input video signal in order to drive the video signals (R, G, B signals) and perform signal processing such as cut-off adjustment, etc.

The RGB driver 20R, 20G, 20B represents a signal processing circuit having a function of perform processing such as clamp, gamma, amplitude, bias adjustment, etc. on the R, G, B signals respectively, and in this case paralleling processing is performed.

The LCD panels 3OR, 30G, 30B are driven by video signals of colors R, G, B respectively, and control the light amount from a light source (not shown).

Timing signals which are required for the RGB drivers 20R, 20G, 20B and the LCD panels 30R, 30G, 30B are generated by the timing generator 40.

FIG. 2 is a functional block diagram showing an example of the detailed construction of the RGB driver shown in FIG. 1. Reference numeral 21 represents a gamma circuit, reference numeral 22 represents a gain/bias adjustment circuit, and reference numerals 23 to 27 represent a sample hold circuit.

Each of the RGB drivers 20R, 20G, 20B is constructed as shown in FIG. 2.

The sample hold circuits 23 to 27 parallel the signal passed through the gamma circuit 21 and the gain/bias adjustment circuit 22 on the basis of three-phase sample hold pulses which are different in phase.

Therefore, three-phase pulse signals of SH1, SH2, SH3 are generated from a clock serving as a reference in the timing generator 40, and supplied to the respective RGB drivers 20R, 20G, 20B.

Of these three-phase pulse signals, SH3 is a pulse for re-sampling, and used to sample and hold the output from the sample hold circuits 23, 24 again.

With respect to the output S3, the sampling and holding is performed only once by the re-sampling pulse SH3.

FIG. 3 is a functional block diagram showing an example of the detailed construction of the peripheral portion of the LCD panel shown in FIG. 1. Reference numeral 30 represents an LCD panel, reference numeral 31 represents an H shift register, reference numeral 32 represents a V shift register, and SW1 to SW3 represent first to third switches.

The LCD panel 30R, 30G, 30B is constructed as show in FIG. 3.

The liquid crystal display device shown in FIG. 1 is applied to a case where a plural simultaneous sampling is performed as a method of driving the LCD display panel.

According to this LCD display panel driving method, there is obtained an advantage that reduction of the signal band and reduction of the clock frequency of the shift register can be performed by subjecting the video signals of the respective colors R, G, B to paralleling processing with the RGB drivers 20R, 20G, 20B.

A method of filtering video signals has been known as a countermeasure of removing high-frequency components contained in the video signals and high-frequency components generated in the processing stage of the video signals in the driving operation of the liquid crystal display device shown in FIGS. 1 to 3.

Here, the disturbance wave due to the conventional filtering processing of the video signals will be described.

FIGS. 4A and 4B show an example of waveform which disturbs a picture on a frame and a displayed image in the liquid crystal driving device. FIG. 4A represents the relationship between the waveform of the video signal and the sampling positions, FIG. 4B represents sampling waveform, and FIG. 4C represents a display result.

In FIGS. 4A and 4B, pixels are disposed in a staggered arrangement, and the sampling timing is varied between odd-number lines and even-number lines.

In FIG. 4A, an upward arrow represents a sampling timing on the LCD panel (30R, 30G, 30B).

That is, in the case of FIGS. 4A and 4B, the relationship between the waveform of the video signal and the sampling position are set so that the sampling is performed at different positions (timing) between the odd-numbered lines and the even-numbered lines as indicated by the upward arrow of FIG. 4A.

Therefore, the sample waveform of each of the odd-numbered line and the even-numbered line as shown in FIG. 4B becomes sample waveform having L level when the video signal is in L level, and also becomes sample waveform having H level when the video signal is in H level.

Further, when the video signal have an intermediate level between the L level and the H level, the sample waveform having the intermediate level can be obtained, for example, like the even-numbered line.

When the LCD panel is driven with the output of the sample waveform shown in FIG. 4B, a frame as shown in FIG. 4C is displayed.

Summarizing the above operation (phenomenon), in the conventional liquid crystal driving device, the pixel and the sampling timing are in one-to-one correspondence with each other, so that the sample waveform of the odd-numbered line and the even-numbered line as shown in FIG. 4B is obtained, and a notch-emphasized pattern due to the structure of the dot arrangement is displayed on the frame as show in FIG. 4C (for example, Japanese Unexamined Patent Application No. Hei-7-261148).

Such a notched pattern as described above is visualized as an obstacle to pictures, and thus the quality of the display image is lowered.

In the case of the conventional liquid crystal driving device, when the method of filtering the video signal is adopted to remove the high-frequency components contained in the video signal and the high-frequency components generated in the processing stage of the video signal, there occurs a problem that such a side effect as greatly lowers sharpness is strong.

Further, when the filter is constructed by an analog circuit, there is also a problem that it is liable to suffer an effect due to dispersion of elements.

SUMMARY OF THE INVENTION

The present invention has an object to provide a liquid crystal driving device which enables a display with high image quality by effectively removing high-frequency components which are contained in video signals to disturb pictures on a display frame and cause image quality to be lowered and are generated in a processing stage of the video signals.

In order to attain the above object, a liquid crystal driving device according to the present invention is characterized in that a timing circuit for generating a sampling pulse is constructed by a PLL circuit comprising a voltage control type oscillator, a phase comparator for synchronizing an oscillation frequency with an input signal, and a filter for smoothening a comparison result, a phase shifter for shifting the clock phase periodically to vary the sampling phase and vary the phase relationship between a signal and a pixel periodically, and input means for an alternating signal which comprises a periodic wave and is modulated every line or every field by a pulse wave, and that a fixed pixel is restructured by periodically varying the phase relationship between the alternating signal and the pixel to provide a visual filtering effect.

Accordingly, firstly, the high frequency components which disturb pictures on the frame and cause reduction in image quality in the conventional liquid driving device can be removed.

Secondly, the high frequency components which occur due to sampling or pixel structure and have been difficult to be removed by the conventional technique can be removed.

Thirdly, a pixel position to be displayed is controlled in place of an operation of video signals, so that a spatial frequency filter can be implemented at a low price.

Fourthly, since no signal processing filter is used, there can be obtained may excellent effects such as an effect that deterioration of sharpness is little, etc.

Further, in the liquid crystal driving device, the timing generator is provided with a variable phase shifter which can control the phase of a sampling block output from the PLL circuit in the timing circuit block, and input means for an alternating voltage signal which periodically varies the phase of the variable phase shifter, thereby periodically varying the phase relationship between the signal and the pixel.

The same effect of the liquid crystal driving device described above can be obtained even when the timing generator thus constructed is used.

Further, in the liquid crystal driving device described above, the timing generator is provided with a variable phase shifter which can control the phase of the clock in the PLL circuit in a timing circuit block, and input means for an alternating voltage signal which periodically varies the phase of the variable phase shifter, thereby periodically varying the phase relationship between the signal and the pixel.

The same effect of the liquid crystal driving device described above can be obtained even when the timing generator thus constructed is used.

DETAILED DESCRIPTION OF THE PREFERRED EMBODIMENTS

Preferred embodiments of the liquid crystal driving device of the present invention will be described with reference to the accompanying drawings.

The liquid crystal driving device of the present invention is characterized in that disturbance components generated due to the pixel structure are removed with a spatial frequency filter effect by controlling the phase of display pixels. Therefore, a timing generator for supplying the RGB driver and the LCD panel with timing signals is improved.

In order to make it easy to understand the present invention, the operation (action) inherent to the liquid crystal driving device of the present invention will be first described with reference to FIGS. 6D to 6F.

Figure 6D:
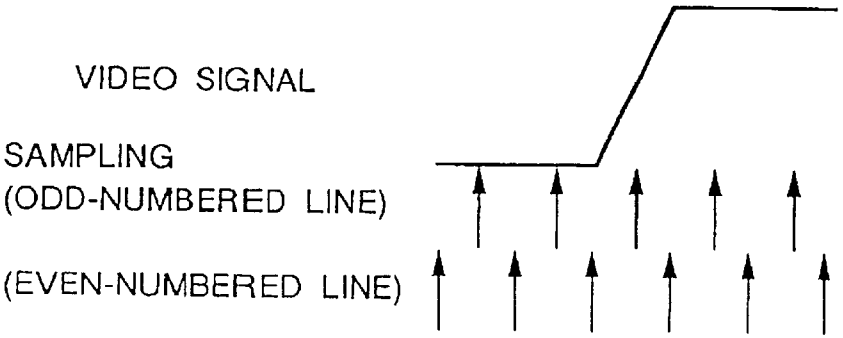
FIGS. 6D to 6F are diagrams showing waveform disturbing pictures on a display frame and an example of a display image when a spatial frequency filter is added in the liquid crystal driving device of the present invention.
Figure 6E:
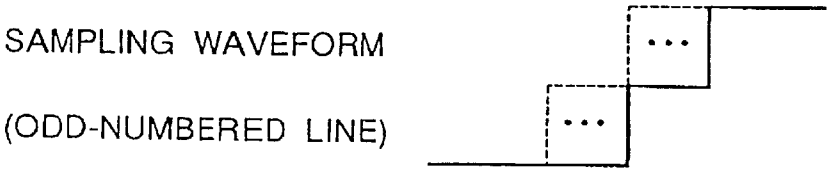
Figure 6E:
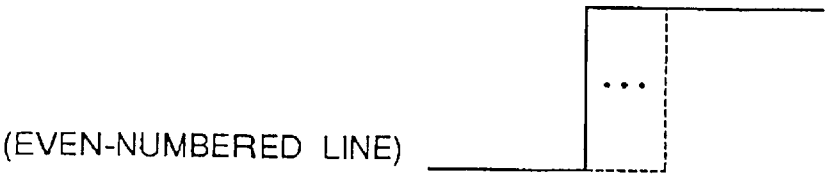
Figure 6F:
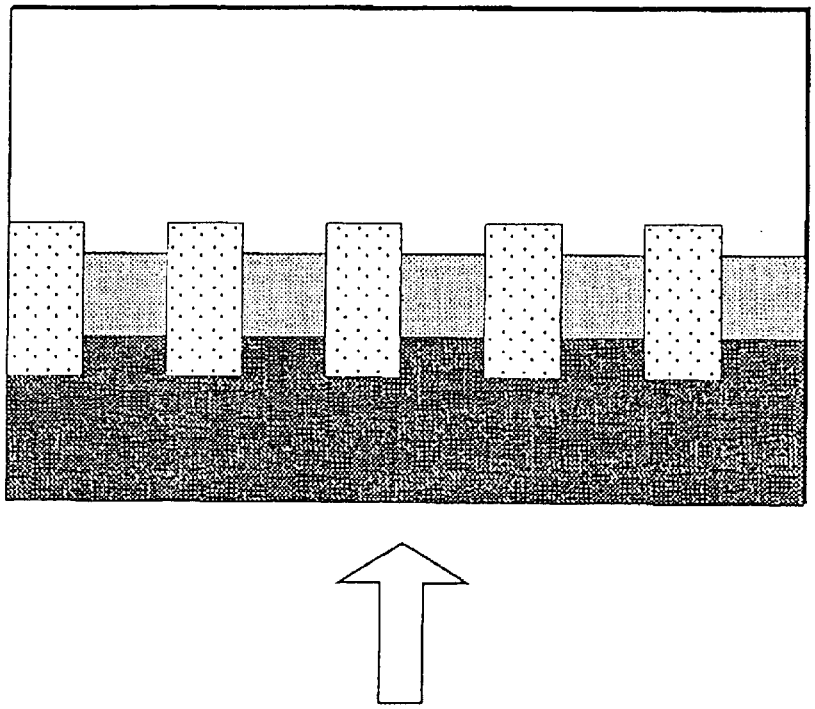

FIGS. 6D to 6F are diagrams showing the waveform disturbing pictures on a display frame when the spatial frequency filter is added, and a displayed image. FIG. 6D represents the waveform of the video signal and the sampling position, FIG. 6E represents the sample waveform, and FIG. 6F represents a display result.

Figure 4A:
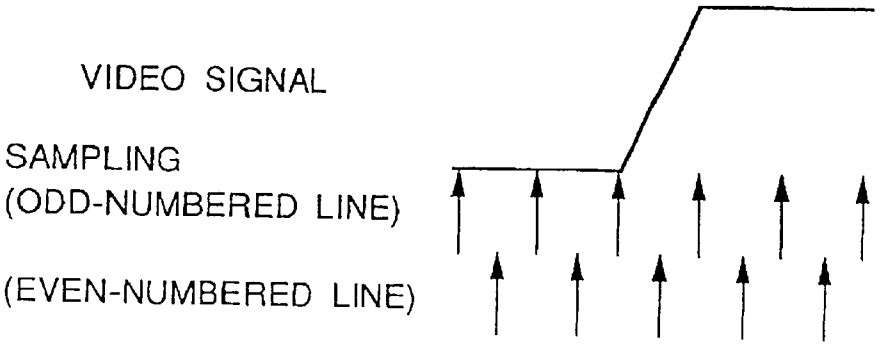
FIGS. 4A to 4C are diagrams showing waveform disturbing pictures on a display frame and an example of a display image in the conventional liquid crystal driving device.
Figure 4B:
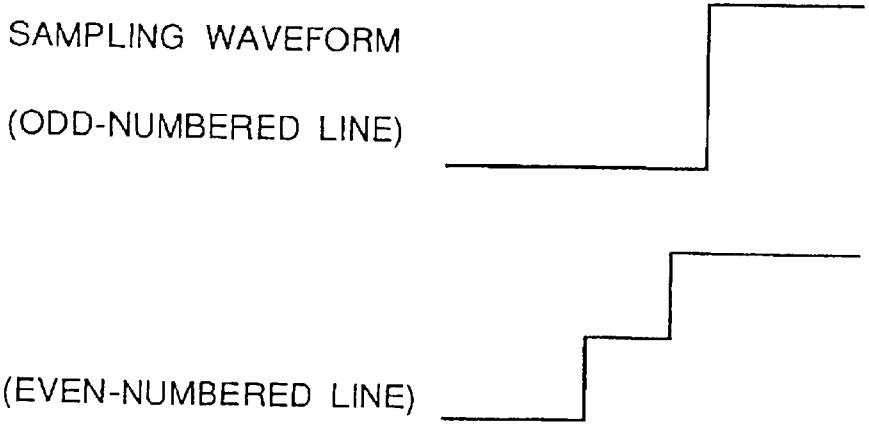
Figure 4C:
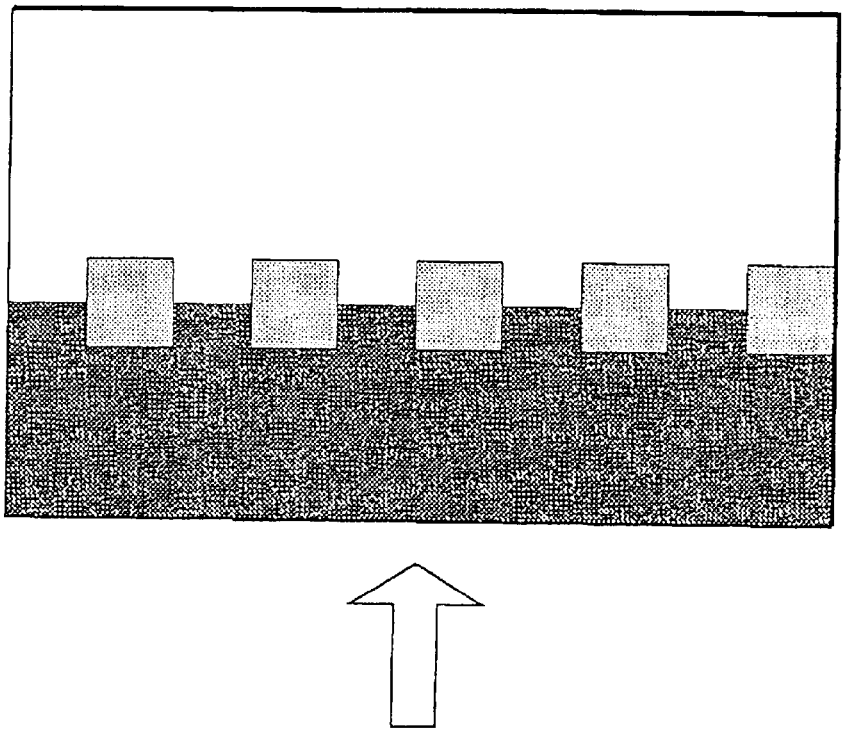

FIGS. 6D to 6F corresponds to FIGS. 4A to 4C which are described in "Description of the Related Art", and show a case where the pixels are disposed in a staggered arrangement. Further, in order to clarify the corresponding relationship therebetween, the waveform of the video signal is likewise varied.

In FIGS. 4A to 4C, the sampling timing is varied between the odd-numbered line and the even-numbered line, and this relationship is fixed at all times. On the other hand, in the case of FIGS. 6D to 6F showing the liquid crystal driving device of the present invention, the relationship between the waveform of the video signal and the sampling position is set so that in a first state the sampling is performed at different positions (timings) between the odd-numbered line and the even-numbered line as indicated by an upward arrow of FIG. 6D, but in a second state (not shown) the sampling is performed at opposite positions (timings) while exchanging the odd-numbered line and the even-numbered line by each other.

That is, the phase of the sampling as indicated by the upper arrow in FIG. 6D is varied every line and further varied every field. Accordingly, the sample waveform is shown in FIG. 6E.

More specifically, for the odd-numbered line shown in FIG. 6E, two sampling timings correspond to one pixel, and thus one pixel makes two displays which are different in brightness every field.

This point is also applied to the even-numbered line shown in FIG. 6E.

As described above, when two pixels which are different in brightness are displayed while superposed on each other, the user perceives it as having the average brightness of the two pixels by a visual integration effect, and thus the pixels at this portion are expressed as having half-tone brightness as shown in FIG. 6F.

If the image of FIG. 6F showing a display result and the image of FIG. 4C are compared with each other, it is apparent that the half-tone portion is more enlarged in the image of FIG. 6F, and the image thus obtained has a less notched pattern.

In other words, it is understood that the picture disturbance can be suppressed.

Figure 1:
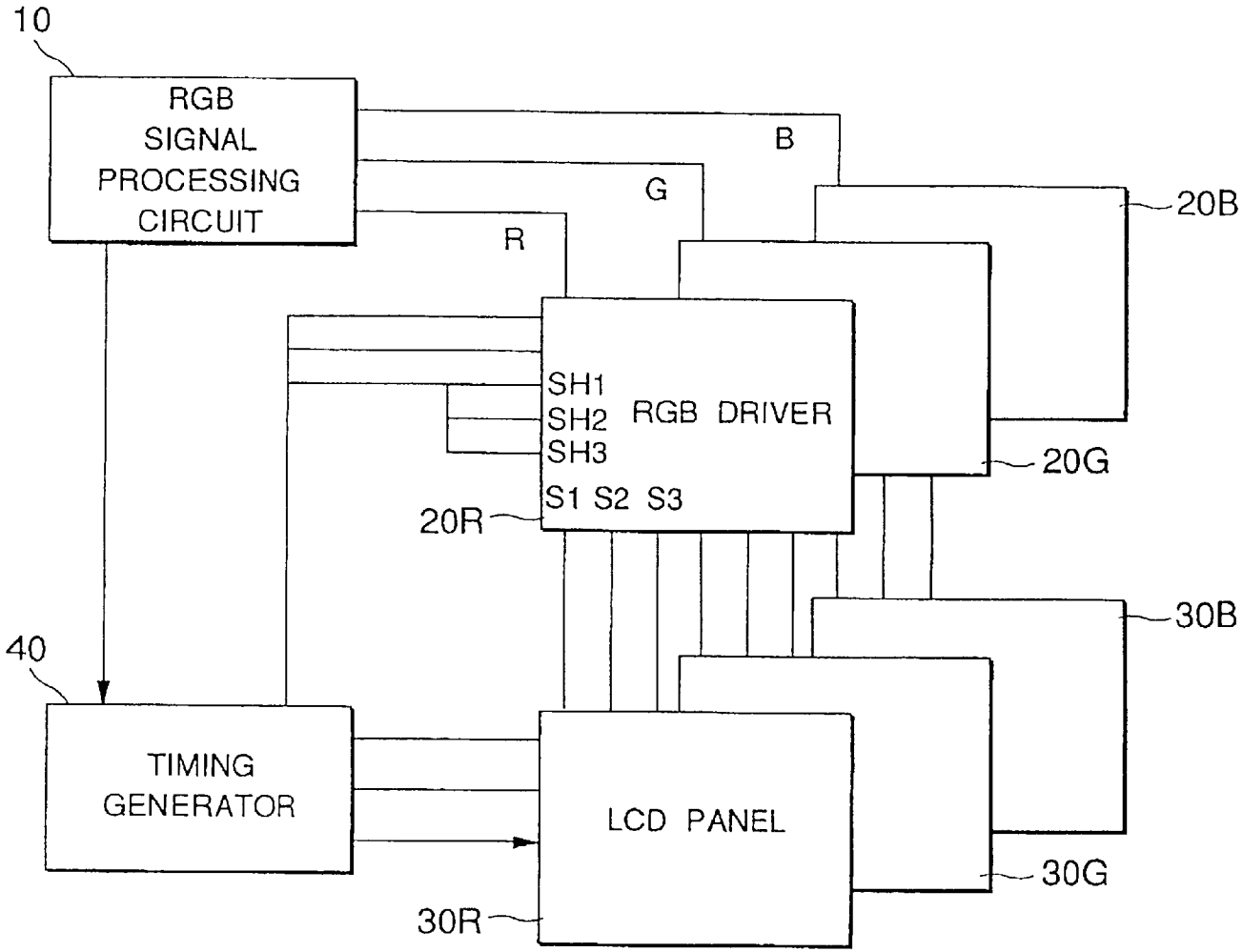
FIG. 1 is a functional block diagram showing an example of the overall system construction of a conventional liquid crystal driving device.
Figure 2:
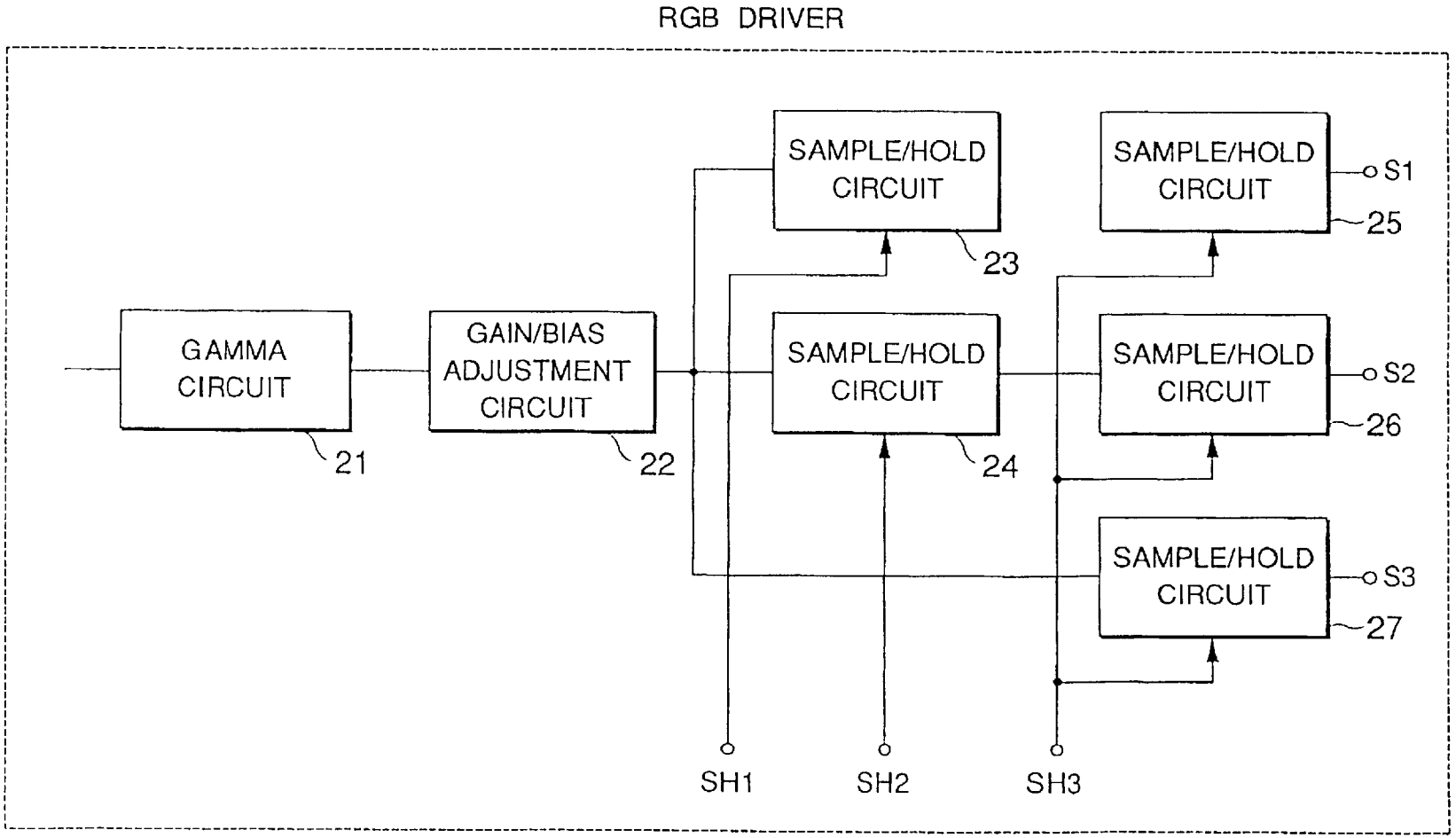
FIG. 2 is a functional block diagram showing an example of the detailed construction of an RGB driver shown in FIG. 1.
Figure 3:
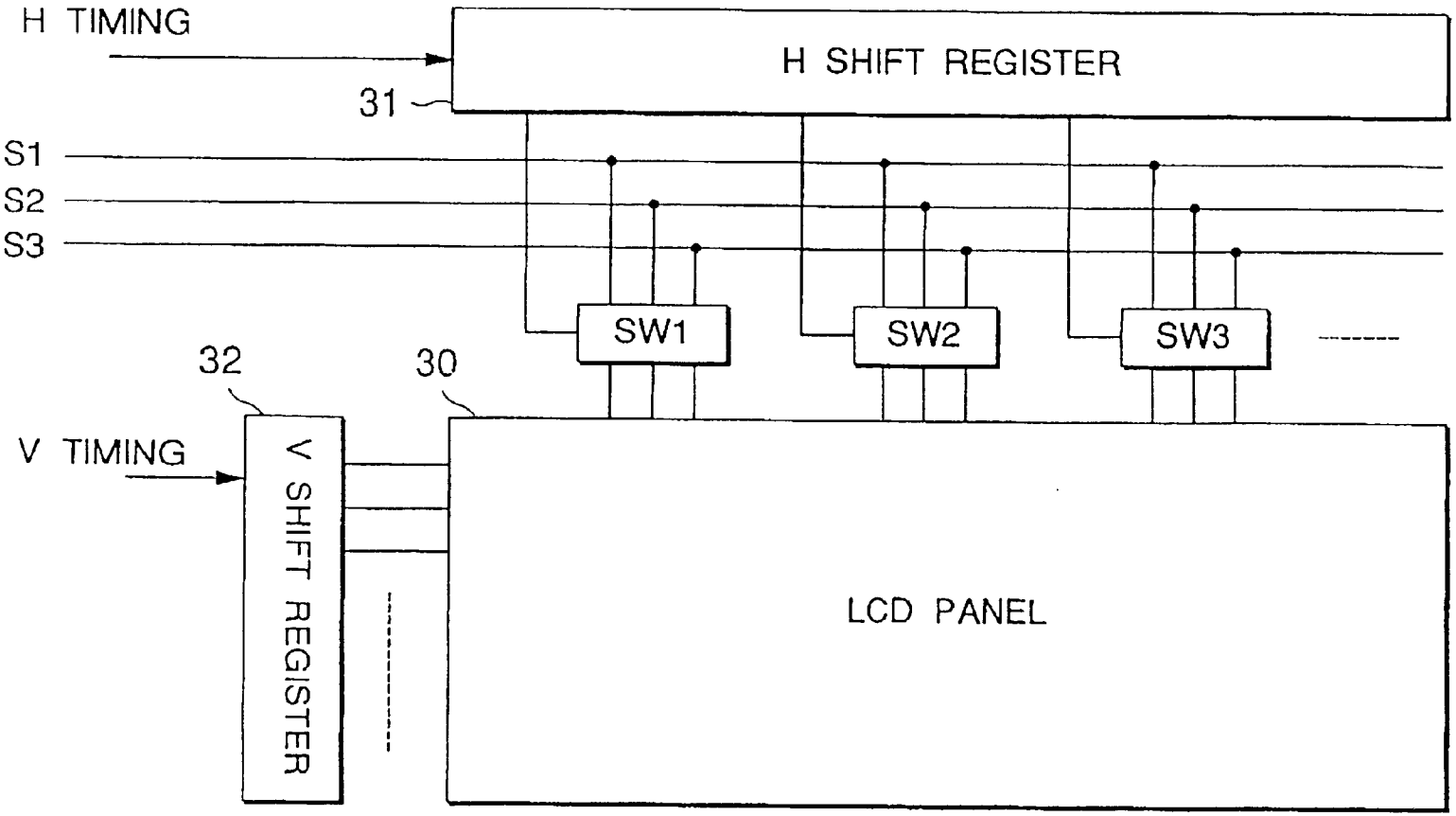
FIG. 3 is a functional block diagram showing an example of the detailed construction of an LCD panel peripheral portion shown in FIG. 1.

In order to display such a picture for which the picture disturbance is suppressed, the timing generator 40 as shown in FIG. 1 is improved in the liquid crystal driving device of the present invention.

Next, an embodiment of the timing generator used in the liquid crystal driving device of the present invention will be described.

Figure 5:
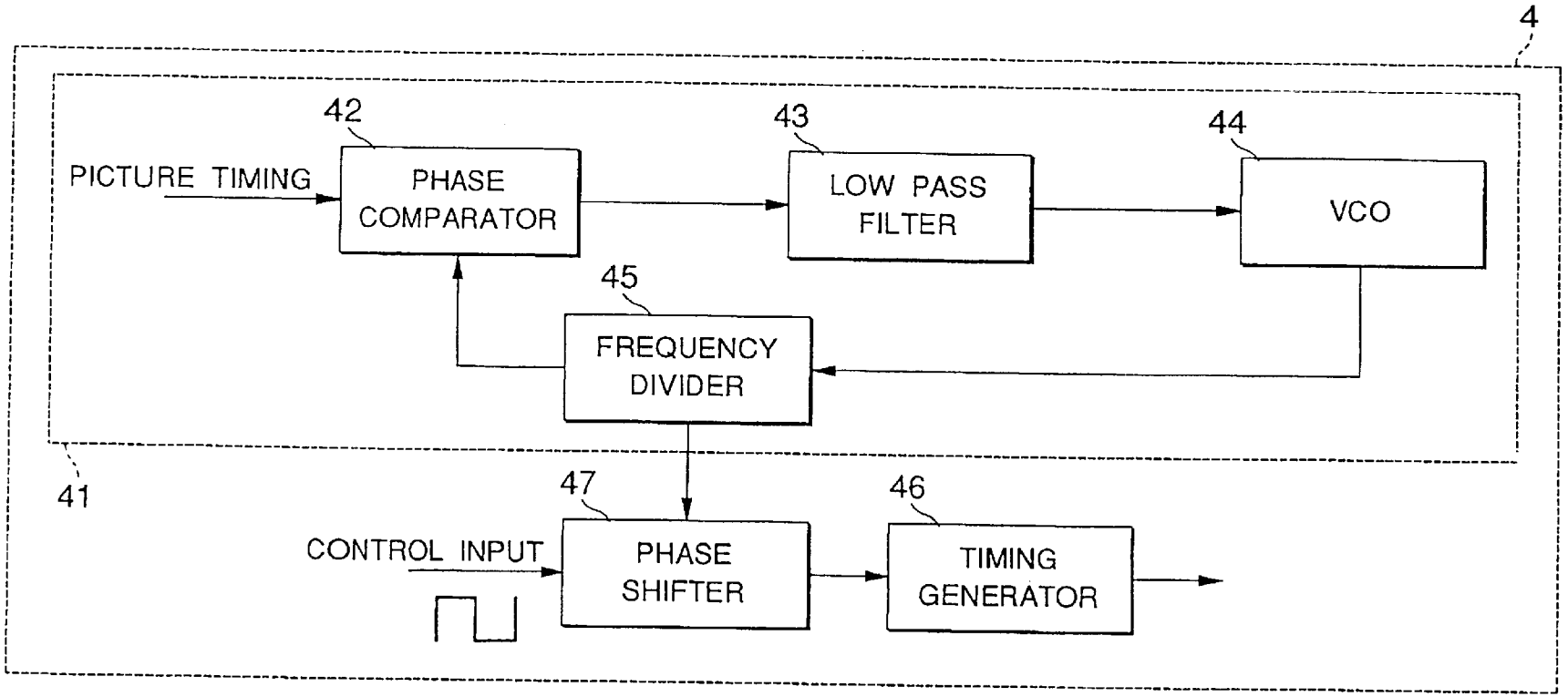
FIG. 5 is a functional block diagram showing the detailed construction of an embodiment of a timing generator used in a liquid crystal driving device according to the present invention.

FIG. 5 is a functional block diagram showing the detailed construction of an embodiment of the timing generator used in the liquid crystal driving device of the present invention. Reference numeral 4 represents a timing generator, reference numeral 41 represents a PLL circuit, reference numeral 42 represents a phase comparator, reference numeral 43 represents a low pass filter, reference numeral 44 represents VCO (voltage control oscillator), reference numeral 45 represents a frequency divider, reference numeral 46 represents a timing generating unit and reference numeral 47 represents a phase shifter.

The timing generator 4 comprises the PLL circuit 41, the timing generating unit 46 and the phase shifter 47 as shown in FIG. 5.

The PLL circuit 41 comprises the phase comparator 42, the low pass filter 43, the VCO 44 and the frequency divider 45 as in the case of the prior art. The PLL circuit 41 operates so that the phase of the video timing detected by the RGB signal processing circuit 10 is made coincident with the phase of the pulse signal obtained by frequency-dividing the oscillation output of the VCO 44 in the divider 45.

The timing generating unit 46 generates the timing signal on the basis of the clock signal generated on the basis of the oscillation output of the VCO 44.

The phase shifter 47 varies the phase delay amount of the output voltage by a control input voltage which is input from the external of the timing generator 4.

Therefore, by varying the control input voltage, the phase of the timing outputs SH1, SH2, SH3 of the timing generating unit 46 is varied, and also the phase of the output signals S1, S2, S3 is varied.

In this case, if the control input voltage is modulated by the pulse waveform every line or every field to periodically vary the phase of pictures to the pixels, a spatial frequency filter in which the variation of the phase corresponds to a cut-off frequency is achieved.

The foregoing description is directed to the construction and function of the timing generator 4 used in the liquid crystal driving device of the present invention.

If the timing generator 4 shown in FIG. 5 is used, the phase of the sampling can be varied every line, and further every field as described above in connection with FIG. 6.

The suppression effect of the picture disturbance as described in connection to FIG. 6 can be also proved by the following theory.

Figure 7:
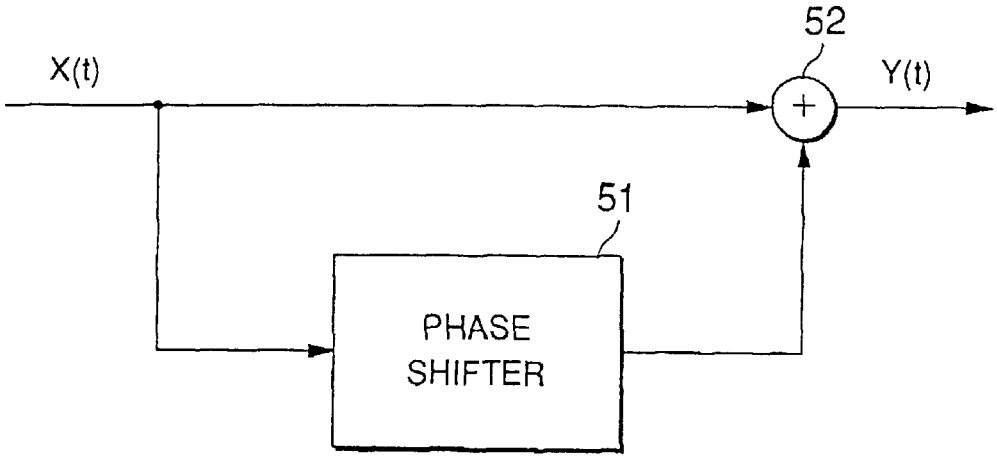
FIG. 7 is a diagram showing an equivalent circuit of the spatial frequency filter used in the liquid crystal driving device of the present invention.

The following description is made on an equivalent circuit of the spatial frequency filter as shown in FIG. 7.

FIG. 7 is a diagram showing the equivalent circuit on the spatial frequency filter used in the liquid crystal driving device of the present invention. Reference numeral 51 represents a phase shifter, and reference numeral 52 represents an adder.

The phase shifter 51 of FIG. 7 generates the following output Y(t) for an input X(t):

$$Y(t)=X(t-\tau) \tag{1}$$

$\tau$ represents a constant. Here, the input X(t) is as follows:

$$X(t)=\sin\omega t \tag{2}$$

In the case of FIG. 7, the output Y(t) is as follows:

$$\begin{aligned} Y(t) &= \sin\omega t + \sin\omega(t-\tau) \\ &= 2\cos\omega(\tau/2)\cdot\sin\omega[t+(\tau/2)] \end{aligned} \tag{3}$$

Accordingly, it is understood that the amplitude of Y(t) has a frequency characteristic.

Here, representing the amplitude component by A, $$A=|2\cos\omega(\tau/2)| \tag{4}$$

Figure 8:
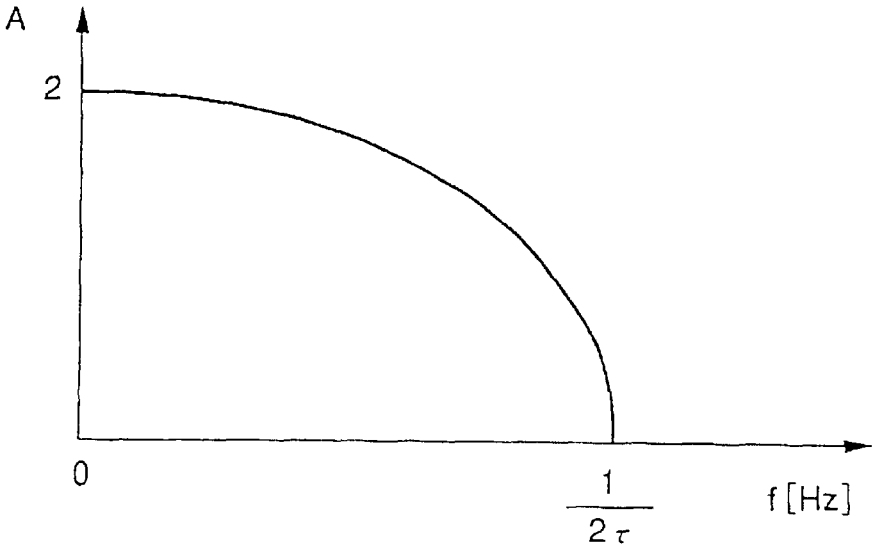
FIG. 8 is a diagram showing the frequency characteristic of the spatial frequency filter shown in FIG. 7.

The waveform of the equation (4) is shown in FIG. 8.

FIG. 8 is a diagram showing the frequency characteristic of the spatial frequency filter shown in FIG. 7. The abscissa of FIG. 4 represents the frequency, and the ordinate represents the amplitude component.

From FIG. 8 and the equation (4), the frequency when the amplitude component A is equal to zero is as follows $$\omega(\tau/2)=[(2n+1)/2]\pi \tag{5}$$

n=an integer of 0, 1, 2, 3,

In the equation (5), assuming that $\omega=2\pi f$, n=0, $$f=1/(2\tau) \tag{6}$$

That is, in this case it is understandable that the frequency is determined by only the constant $\tau$.

In the equation (6), if the value of the constant $\tau$ is set to the time corresponding to one pixel on the display frame and it is set to 25 [ns], the frequency f when the amplitude component A is equal to zero is as follows:

$$f = 1/(2\times25\times10^{-9}) \quad (7)$$
$$= 20 \text{ [MHz]}$$

Through the above operation, the high-frequency components which disturb pictures can be removed accurately and stably for a long term.

In this case, any circuit for filtering the video signal is not required, and the device can be implemented at a low price.

First Embodiment

Figure 9:
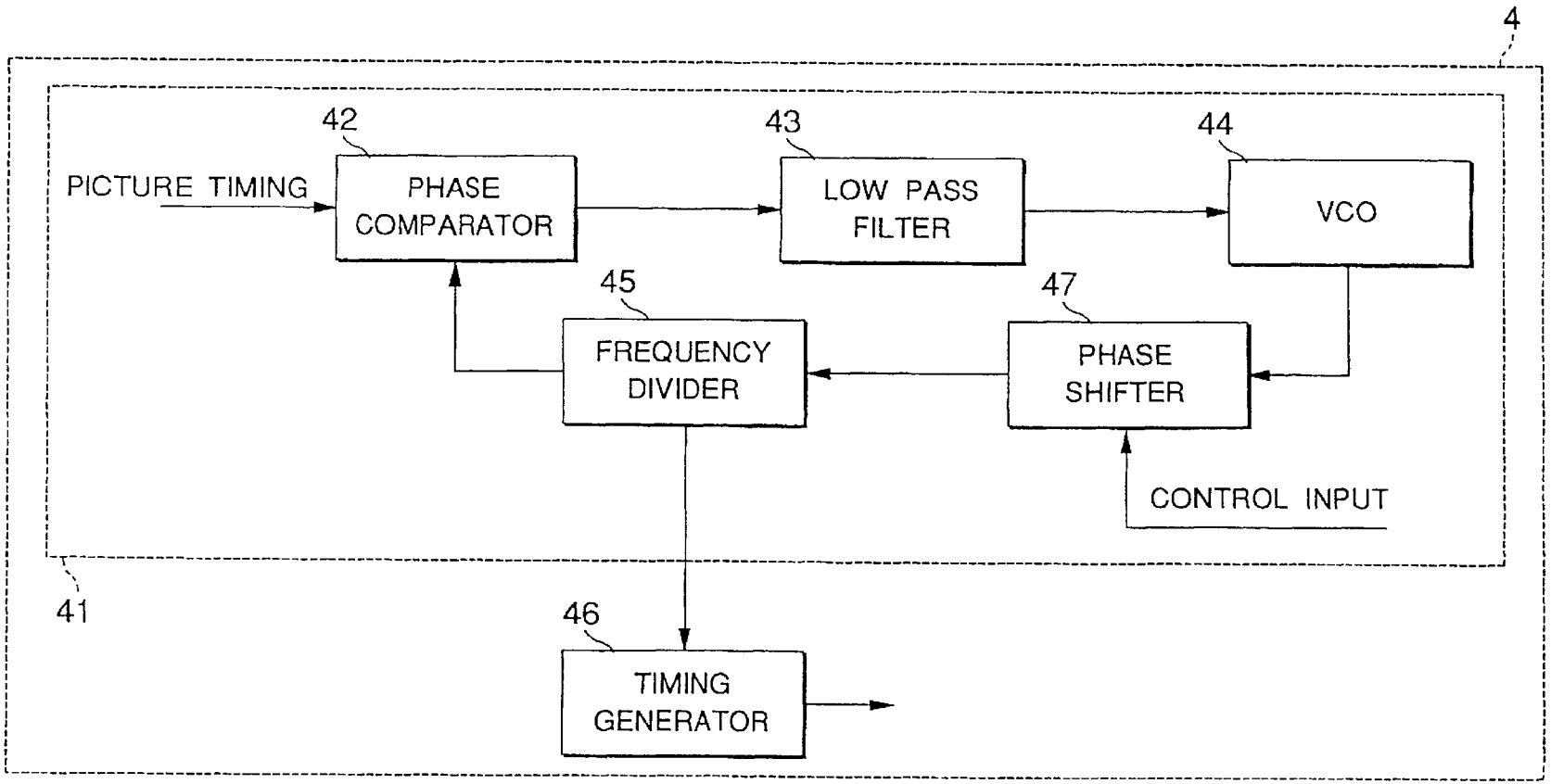
FIG. 9 is a functional block diagram showing a first embodiment of the detailed construction of the timing generator shown in FIG. 5.

FIG. 9 is a functional block diagram showing a first embodiment of the detailed construction of the timing generator shown in FIG. 5. In FIG. 9, the same reference numerals as FIG. 5 represent the same elements as FIG. 5.

In the timing generator shown in FIG. 9, the phase shifter 47 shown in FIG. 5 is provided in the PLL circuit 41.

The phase shifter 47 operates to vary the phase of the reference clock to be supplied from the frequency divider 45 to the timing generating unit 46.

In the case of FIG. 9, the phase variation is controlled by a control input which is supplied to the phase shifter 47, and the same operation as shown in FIG. 5 is carried out.

However, in the circuit of FIG. 9, the phase control is performed in the PLL loop, so that it is necessary to set the constant at the response time of the PLL circuit 41 to a sufficient constant relative to the period of the alternating waveform (control waveform).

The above setting can avoid the disadvantage that the phase variation occurs in the display frame.

No critical visual problem occurs if the period of the alternating waveform is the same level as the horizontal frequency.

As described above, according to the first embodiment, the timing circuit for generating the sampling pulse is provided with the variable phase shifter 47 which can control the phase of the sampling block output from the PLL circuit 41 in the timing circuit block, and the alternating voltage signal for periodically varying the phase of the variable phase shifter 47 to periodically varying the phase relationship between the signal and the pixel, thereby providing the visual filtering effect.

Second Embodiment

Figure 10:
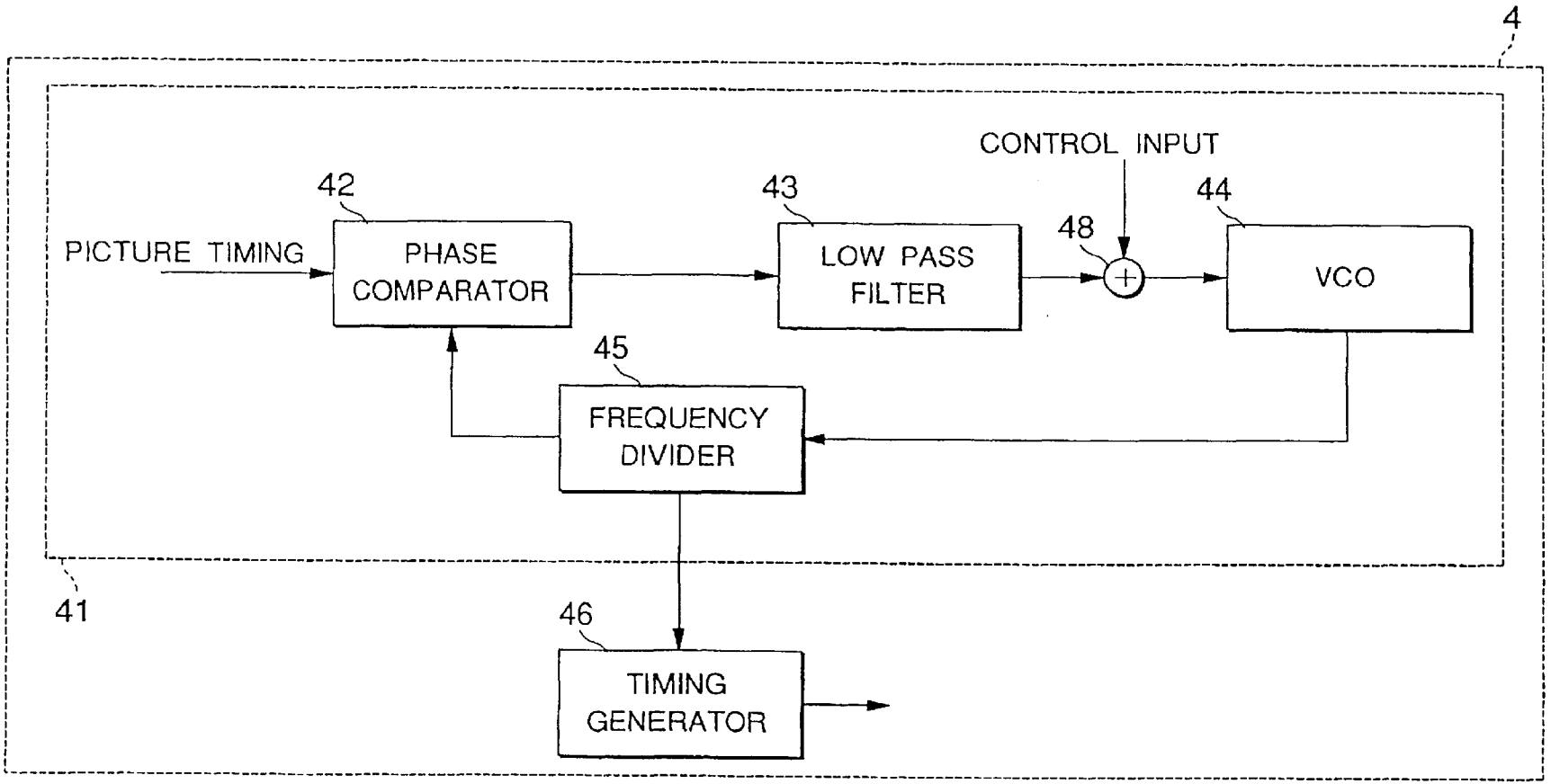
FIG. 10 is a functional block diagram showing a second embodiment of the detailed construction of the timing generator shown in FIG. 5.

FIG. 10 is a functional block diagram showing a second embodiment of the detailed construction of the timing generator shown in FIG. 5. In FIG. 10, the same reference numerals as FIG. 5 represent the same elements as FIG. 5, and reference numeral 48 represents an adder.

The timing generator shown in FIG. 10 is characterized in that the phase shifter 47 provided in the circuit of FIG. 5 and FIG. 9 is removed and the adder 48 is added in place of the phase shifter 47. As shown in FIG. 10, the newly added adder 48 is disposed at the output side of the low pass filter 43 and at the input side of the VCO 44.

As described above, even when the adder 48 is provided to the filter portion to superpose the alternating waveform for phase control, the same operation as the circuit of FIG. 5 can be performed. That is, in the case of FIG. 10, the phase of the oscillation clock of the VCO 44 is periodically controlled. Therefore, when the oscillation clock of the VCO 44 is frequency-divided by the divider 45 and output to the timing generator 46, the sampling phase generated in the timing generator 46 is varied likewise, and thus the same effect as FIG. 5 can be obtained.

In the circuit of FIG. 10, the phase control is performed in the PLL loop as in the case of the circuit of FIG. 9 described in the first embodiment, and thus it is necessary to set the constant at the response time of the PLL circuit 41 to a sufficiently long value relatively to the period of the alternating waveform (control waveform). Therefore, there is a restriction in time constant, however, it is no practically critical problem.

As described above, in the second embodiment, the timing circuit for generating the sampling pulse is provided with the variable phase shifter 47 which can control the phase of the clock in the PLL circuit 41 in the timing circuit block, and the alternating voltage signal for periodically varying the phase of the variable phase shifter 47 to periodically vary the phase relationship between the signal and the pixel, thereby bringing the visual filtering effect.

What is claimed is:

1. A driving device for a liquid crystal display device for sampling video signals at a fixed period to display a color image on a panel, wherein a timing circuit for generating a sampling pulse includes:

a PLL circuit for generating and synchronizing a clock signal for sampling an input video signal, said PLL circuit comprising:

a voltage control type oscillator for generating an oscillation frequency, a phase comparator for comparing and synchronizing said oscillation frequency with the phase of said input video signal, and a frequency divider for generating said clock signal by frequency dividing the phase synchronized oscillation frequency;

a phase shifter for shifting the phase of said clock signal to vary the sampling phase between even and odd lines of said input video signal to be displayed and to further vary the sampling phase for every other line of said input video signal; and a timing generator unit for generating said sampling pulse on the basis of the phase shifted clock signal; said sampling pulse alternating the phase relationship for every line and every field of said input video signal, thereby providing a visual filtering effect.

2. The liquid crystal driving device according to claim 1, wherein said phase shifter has input means for an alternating voltage signal which periodically varies the phase of said clock signal, thereby periodically varying the phase relationship between lines of the input video signal.

3. The liquid crystal driving device according to claim 1, wherein said phase shifter is provided in said PLL circuit and has input means for an alternating voltage signal which periodically varies the phase of said clock signal, thereby periodically varying the phase relationship between lines of the input video signal.

4. The liquid crystal driving device according to claim 1, wherein said PLL circuit further comprises an adder for adding an alternating voltage signal to the phase synchronized oscillation frequency to periodically vary the phase of said clock signal, thereby periodically varying the phase relationship between lines of the input video signal.

* * * * *